United States Patent [19]

Bradley et al.

[11] Patent Number: 5,040,589

[45] Date of Patent: Aug. 20, 1991

[54] METHOD AND APPARATUS FOR THE INJECTION MOLDING OF METAL ALLOYS

[75] Inventors: Norbert L. Bradley, Sanford; Regan D. Wieland, Auburn; William J. Schafer, Saginaw; Allen N. Niemi, Houghton, all of Mich.

[73] Assignee: The Dow Chemical Company, Midland, Mich.

[21] Appl. No.: 309,758

[22] Filed: Feb. 10, 1989

[51] Int. Cl.[5] ..... B22D 17/00

[52] U.S. Cl. ..... 164/113; 164/312; 164/900

[58] Field of Search ..... 164/80, 900, 113, 284, 164/312, 313, 314, 315

[56] References Cited

U.S. PATENT DOCUMENTS

| | | | |
|---|---|---|---|
| 2,386,966 | 3/1943 | MacMillin . | |
| 2,529,146 | 11/1950 | Feitl . | |
| 3,048,892 | 8/1959 | Davis, Jr. et al. . | |
| 3,189,945 | 6/1965 | Strauss . | |
| 3,550,207 | 12/1970 | Strauss . | |
| 3,874,207 | 4/1975 | Lemelson . | |
| 3,893,792 | 7/1975 | Laczko . | |
| 4,212,625 | 7/1980 | Shutt . | |
| 4,330,026 | 5/1982 | Fink . | |
| 4,473,103 | 9/1984 | Kenney et al. | 164/900 |
| 4,559,991 | 12/1985 | Motomura et al. . | |
| 4,586,560 | 5/1986 | Ikeya et al. . | |
| 4,687,042 | 8/1987 | Young | 164/113 |
| 4,694,882 | 9/1987 | Busk | 164/900 |
| 4,771,818 | 9/1988 | Kenney | 164/900 |
| 4,964,881 | 9/1987 | Busk | 164/900 |

*Primary Examiner*—Richard K. Seidel
*Assistant Examiner*—Rex E. Pelto
*Attorney, Agent, or Firm*—John K. McCulloch

[57] ABSTRACT

A method and apparatus for injection molding a metal alloy wherein the alloy is maintained in a thixotropic, semi-solid state in a reciprocating extruder at temperatures above its solidus temperature and below its liquidus temperature in the presence of shearing and then injected as a thixotropic slurry into a mold to form a useful product. Following completion of the injection molding stroke the nozzle of the extruder is sealed by a solidifying a portion of the residue of the alloy remaining in the nozzle.

58 Claims, 6 Drawing Sheets

METHOD AND APPARATUS FOR THE INJECTION MOLDING OF METAL ALLOYS

This invention relates to a method and apparatus for the injection molding of metal alloys which, under proper conditions of heat and shear, form a two-phase thixotropic slurry.

BACKGROUND OF THE INVENTION

Metal alloys having dendritic crystal structure at ambient temperature conventionally have been melted and then subjected to high pressure die casting procedures. Such conventional die casting procedures have certain problems associated therewith such as melt loss, contamination with flux or the like, excessive scrap, rather high energy consumption, somewhat lengthy duty cycles, limited die life due to high thermal shock or the like, and restricted die filling positions. The alloys involved include, but are not limited to, alloys described in U.S. Pat. Nos. 3,840,365; 3,842,895; 3,902,544; and 3,936,298.

Plastics injection molding techniques have many features which would be advantageous if they could be included in the injection molding of such metal alloys which can be converted into a thixotropic state. Such techniques include the feeding of plastic granules at room temperature from a hopper into a screw extruder in the absence of flux and other impurities. The plastic material is heated in the extruder to become plasticized, following which a mold positioned at the discharge end of the extruder is filled with the flowable material. There are no contamination and melt losses associated with plastic extrusion procedures, and the lower temperatures utilized in such procedures reduce the problem of thermal shock to the mold. In injection molding of plastics, the mold can be filled from any position as dictated by maximum efficiency for part fillings. Apparatus and methods according to the invention include most, if not all, of these desirable characters.

U.S. Pat. Nos. 4,694,881 and 4,694,882 disclose the conversion of a metal alloy having dendritic properties into a thixotropic, semi-solid state by controlled heating so as to maintain the alloy at a temperature above its solidus temperature and below its liquidus temperature while subjecting the alloy to a shearing action during injection molding. In this manner certain advantages of injection molding can be utilized to overcome certain disadvantages of die casting. The present invention incorporates additional improvements and advantages resulting from the injection molding of metal alloys.

SUMMARY OF THE INVENTION

Previously known methods for the injection molding of thixotropic metal alloys may be improved substantially by establishing and maintaining a temperature profile for a given alloy by heating the alloy in a screw extruder to a temperature above its solidus temperature and below its liquidus temperature and, prior to the injection stroke, avoiding the imposition of any appreciable increase of force on the alloy. This is accomplished by delivering the semi-solid material to an accumulation space or zone between the extruder nozzle and the extruder screw tip and withdrawing or retracting the screw, while it rotates, in a direction away from the discharge nozzle as the space between the nozzle and the tip of the screw is filled with material. In conventional plastics injection molding the retraction of the extruder screw is accomplished by pressure buildup in the space between the nozzle and the extruder screw tip.

Because of the nature of metal alloys it has been found necessary to control carefully the stages of pressurization of such alloys in their semi-solid state in the extruder. A desired shearing rate must be maintained, thus dictating the speed of rotation of the screw and the rate at which material is fed to the extruder. This further dictates the speed of retraction of the screw prior to the injection stroke. Still further, when injection molding a semi-solid metallic material, it is important to control temperature, pressure, and extruder screw speed conditions to prevent phase separation of the combined liquid-solid states of the alloy.

In controlling the temperature profile, feeding rate, shearing speed, injection pressure, and injection velocity to the extent to be described hereinafter, plastics injection molding procedures and machines advantageously may be adapted for use in the forming of die cast parts from metal alloys. By a reduction in pressure at the end of the injection stroke in the vicinity of the extruder nozzle, accompanied by a reduction in temperature in the nozzle, as well as the absence of shearing action, a plug of solidified metal may be formed in the nozzle of such nature as to eliminate the need for a conventional mechanical shut-off valve and the problems attendant such a valve. If desired, however, it is possible to make use of a conventional shut off valve in the nozzle.

Other advantages of the improved method and apparatus of the present invention will become apparent from the following description.

THE DRAWINGS

DETAILED DESCRIPTION

Injection molding of a metal alloy is a unique process for the production of high quality molded parts. The process differs from high pressure die casting in that it starts with room temperature pellets, powder, or chips and feeds them under inert atmospheric conditions thus eliminating the traditional melting pot and its inherent problems. It also differs from the recently developed injection molding process that uses a plastic or wax binder as a flow aid. Since no binder is used, the molded metal article is the finished product and requires no debinding process. The technology involved in the present invention is based on the formation of a semi-solid thixotropic slush which enables the metal to be injection molded.

Properties of the molded parts produced according to the invention compare favorably with high pressure die cast parts. In certain respects parts made in accordance with the injection molding process of the present invention show improved properties. For example, injection molded parts produced in accordance with the invention consistently exhibit lower porosity than similar die cast counterparts. Porosity significantly reduces the allowable design strength of a part. Thus, the more sound parts obtained by use of the invention represents a significant advance over conventional die cast parts.

Figure 1:
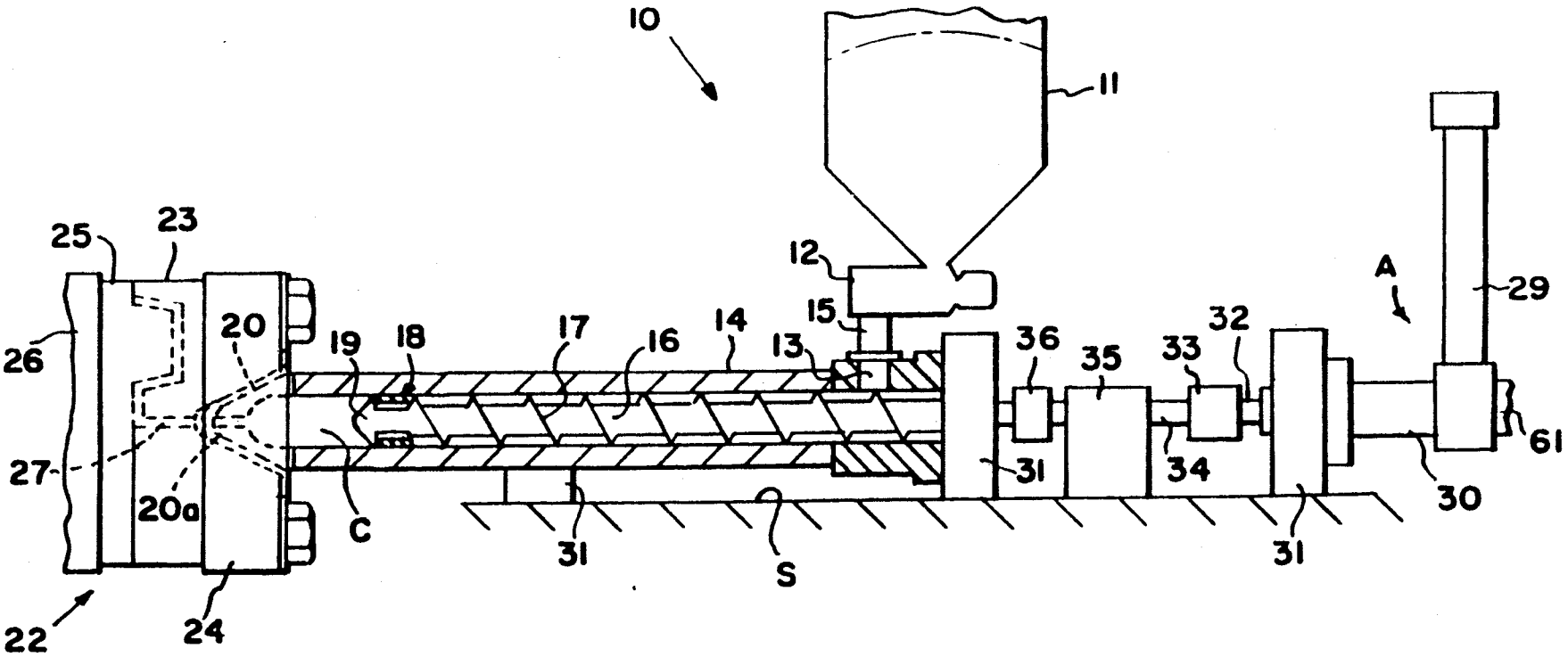
FIG. 1 is a schematic side view, partly in section, of injection molding apparatus constructed in accordance with the invention.

FIG. 1 schematically illustrates a substantially conventional form of thermoplastic injection molding machine 10 incorporating certain modifications hereinafter described to enable semi-solid metallic material to be molded according to the invention. The machine 10 includes a feed hopper 11 for the accommodation of a supply of pellets, chips, or powder of a suitable metal alloy at room temperature. For purposes of describing the salient features of the subject invention, magnesium alloys will be referred to as examples of suitable metal alloys that may be used in practicing the invention.

A suitable form of feeder 12, such as an Acrison 105E volumetric feeder, is in communication with the bottom of the hopper 11 to receive pellets therefrom by gravity. The feeder includes an auger (not shown) which functions to advance pellets at a uniform rate to the extruder. The feeder 12 is in communication with a feed throat 13 of an extruder barrel 14 through a vertical conduit 15 which delivers a quantity of pellets into the extruder barrel 14 at a rate determined by the speed of the feeder auger. An atmosphere of inert gas is maintained in the conduit 15 and extruder barrel 14 during feeding of the pellets so as to prevent oxidation thereof. A suitable inert gas is Argon and its supply is effected in a conventional manner.

As is conventional in a thermoplastic injection molding machine, barrel 14 accommodates a reciprocable and rotatable extruder screw 16 provided with a helical flight or vane 17. Adjacent the discharge end of the barrel the screw has a non-return valve assembly 18 and terminates in a screw tip 19. The discharge end of barrel 14 is provided with a nozzle 20 having a tip 20*a* received and aligned by a sprue bushing 21 (FIGS. 4 and 5) mounted in a suitable two-part mold 22 having a stationary half 23 fixed to a stationary platen 24. The mold half 23 cooperates with a movable mold half 25 carried by a movable platen 26. The mold halves define a suitable cavity 27 in communication with the nozzle as will be described in greater detail. Mold 22 may be of any suitable design including a runner spreader 28 in communication with the cavity 27 and through which the semi-solid material may flow to the cavity in the mold. Although not shown in the drawings, suitable and conventional mold heating and/or chilling means may be supplied if required.

The opposite end of injection molding machine 10 includes a known form of high speed injection apparatus A including an accumulator 29 and a cylinder 30 supported by stationary supports 31 on a suitable support surface S. Downstream from the cylinder 30 a shot or injection ram 32 projects into a thrust bearing and coupler 33 for operational connection in known manner with a drive shaft 34 for the rotary and reciprocable extruder screw 16. Thrust bearing and coupler 33 separates shot ram 32 from drive shaft 34 so that shot ram 32 may merely reciprocate and not rotate when desired. Drive shaft 34 extends through a conventional form of rotary drive mechanism 35 which is splined to drive shaft 34 to permit horizontal reciprocation of drive shaft 34 in response to reciprocation of shot ram 32 while the drive shaft 34 rotates. This shaft is in turn coupled with extruder screw 16 through a drive coupling 36 of known type to transmit rotation to extruder screw 16 as well as high speed axial movement within barrel 14 in response to operation of high speed injection apparatus A. It will be understood that suitable and conventional hydraulic control circuits (partially shown in FIG. 6) will be used in the conventional manner to control the operation of injection molding machine 10 in the manner to be described.

Typically, operation of injection molding machine 10 involves rotation of extruder screw 16 within barrel 14 to advance and continuously shear the feed stock supplied through feed throat 13 to a material accumulation chamber C (FIG. 1) between the screw tip 19 and the nozzle. Suitable heating means of a type to be described supply heat to barrel 14 to establish a temperature profile which results in conversion of the feed stock to a slushy or semi-solid state at a temperature which is above its solidus temperature and below its liquidus temperature. In this semi-solid state the material is subjected to shearing action by the extruder screw 16 and such material is continuously advanced toward the discharge end of the barrel to pass the non-return valve 18 in sufficient accumulated volume ultimately to permit high speed forward movement of extruder screw 16 to accomplish a mold filling injection or shot. High speed injection apparatus A functions at the appropriate time (in a manner to be explained) to move shot ram 32 forwardly, or toward the discharge end of the extruder, which results in forward movement of the thrust bearing 33 and drive shaft 34. Since drive shaft 34 is coupled to the shaft of extruder screw 16 through coupling 36, extrude screw 16 moves forward quickly to accomplish the mold filling shot. Non-return valve assembly 18 prevents the return or backward movement of the semi-solid metal accumulated in the chamber C during the mold filling shot.

Figure 2:
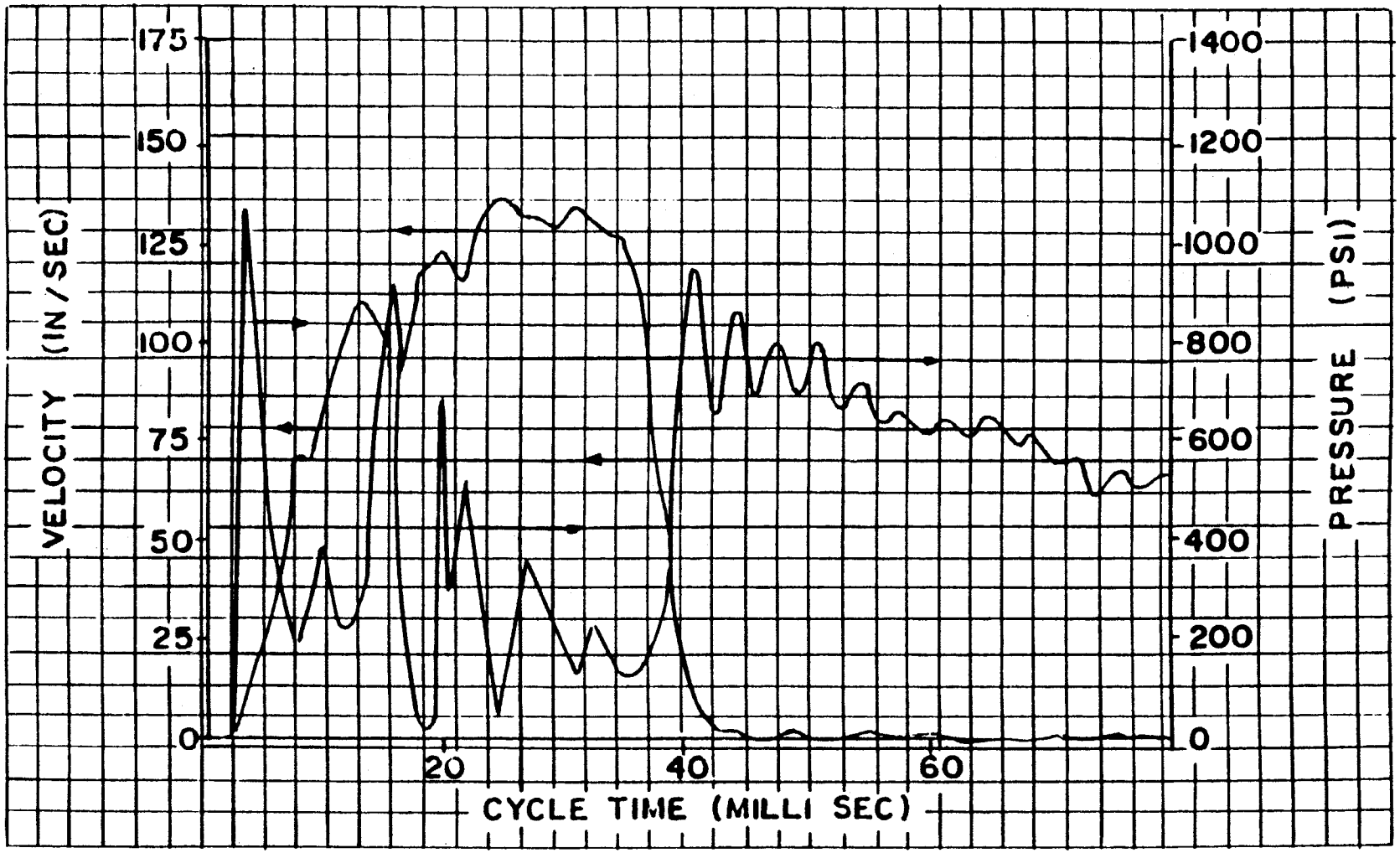
FIG. 2 is a graph illustrating a typical shot trace showing screw velocity and hydraulic fluid pressure during the injection stroke.

FIG. 2 illustrates a typical shot trace plotting extruder screw shot velocity in inches per second as well as extruder screw hydraulic fluid shot pressure in pounds per square inch versus shot cycle time in milliseconds. This shot trace or profile is not appreciably different from that resulting from high pressure die casting. In both instances, the mold must be filled quickly so as to avoid solidification of the metal. This requires in the present system a high linear velocity of the ram and screw system (typically 50–190 in/sec).

An important objective of the invention is to reach a maximum injection velocity in a short time during the first part of the shot cycle, maintain such velocity for a sufficient time to establish the requisite shot size and then rapidly reduce the velocity to zero just as the mold cavity is filled to avoid impact and rebound of the extruder screw 16.

The temperature profile of the metal alloy during injection molding is also of particular importance and, in general, such profile involves increasing temperatures throughout a plurality of heating zones with the last (downstream) zone in the extruder nozzle area permitting a slight reduction in alloy temperature at the nozzle tip 20*a*. The slight reduction in temperature at the nozzle tip cooperates with the reduction in pressure at the completion of the injection stroke to permit the formation of a plug from the residue of metal remaining in the nozzle tip. The plug is formed from the very last portion of the shot of metal and is basically solidified metal. The use of such a plug eliminates the need for a mechanical shut-off valve, inasmuch as the plug serves this function. The plug is not disturbed during refilling of the accumulation chamber C because of the retraction of the screw 16 during such filling stage, as will be explained.

There are two principal methods of feeding a screw extruder of the type under consideration. One method is starve feeding and involves delivering the material to the barrel at such rate that the material in the barrel is less than the barrel's full capacity. Accordingly, output of the extruder is controlled by feeder 12. The second method is flood feeding and is achieved by simply filling feed throat 13 with pellets and allowing the screw to convey the material away at the maximum possible rate. In this case, the extruder output is dependent upon the design of the screw 16 and its speed of rotation.

Thermoplastic screw extruders are typically operated under flood feed conditions. The pumping action of the vanes or flights of the extruder screw causes pressure to build in advance of the extruder screw thereby forcing the screw to move rearwardly in the barrel as the accumulation zone becomes packed with material, thus establishing an automatic return or retraction of the screw to commence a new cycle. With this experience logic would suggest that flood feeding of magnesium alloy pellets would also be the preferred method of operation because the accumulation zone C then would be packed with thixotropic slurry instead of risking the possibility that starve feeding would result in the accumulation zone's being incompletely filled and the consequent possibility of air entrapment in the molded products. However, no appreciable difference in product quality has been found when flood feed or starve feed conditions are utilized. It has been found, however, that starve feeding of metallic material is preferable to flood feeding inasmuch as less torque is required to rotate the extruder screw. It thus is possible to control the shearing transmitted to the slurry by means of the speed of rotation of the screw 16, and independently of the throughput. Screw rotation may be in the range of 125–175 rpm, but can vary to accommodate specific molding conditions.

From the foregoing it will be clear that the screw 16 not only assists in advancing the semi-solid material along the barrel 14 of the extruder into the accumulation chamber C, but also effects shearing of the material in the extruder to prevent undesirable dendritic growth and liquid-solid phase separation during the injection cycle. Rotation of the screw 16 is maintained at a speed to establish a shear rate of between about 5 and 500 reciprocal seconds.

As referred to above, a plug of solid metal is formed in the nozzle from the residue remaining following completion of the filling of the mold. The plug is totally effective in preventing drool, thus eliminating the need for a mechanical valve at the discharge end of the nozzle 20. The absence of pressure upstream of the plug not only permits the plug to remain in place until the next shot, but also avoids the possibility of phase separation of the solid and liquid components forming the slush.

The extruder screw 16 may be constructed from a suitable material such as hot work tool steel having a suitable, hard facing material on the flights 17 and the inner surface of the barrel 14. A typical tolerance between the outer diameter of the screw and the inner surface of barrel 14 at normal operating temperatures is 0.015 inch. The flights 17 of the screw extend beyond feed throat 13 toward support member 31 to prevent the packing of magnesium fines in the hub of the screw shaft which can stall rotation of the screw.

Barrel 14 is preferably bimetallic having an outer shell of alloy I-718, which is a high nickel alloy and provides strength and fatigue resistance at operating temperatures in excess of 600° C. Since the alloy I-718 will corrode rapidly in the presence of magnesium at the temperatures under consideration, a liner of a high cobalt material, such as Stellite 12 (Stoody-Doloro-Stellite Corporation) is shrunk fit onto the inner surface of the barrel 14. Any appropriate bimetallic barrel having chemical and thermal resistance, sufficient strength to withstand shot pressures, and resistance to wear may be used.

A typical magnesium alloy that can be used in practicing the invention is AZ91B, containing 90% Mg, 9% Al, and 1% Zn. This alloy has a solidus temperature of 465° C., a liquidus temperature of 596° C., and a desirable slush morphology temperature of approximately 580°–590° C., preferably 585° C. Thus, the apparatus of the subject invention must operate at temperatures which are much higher than those encountered in thermoplastic injection molding.

Figure 3:
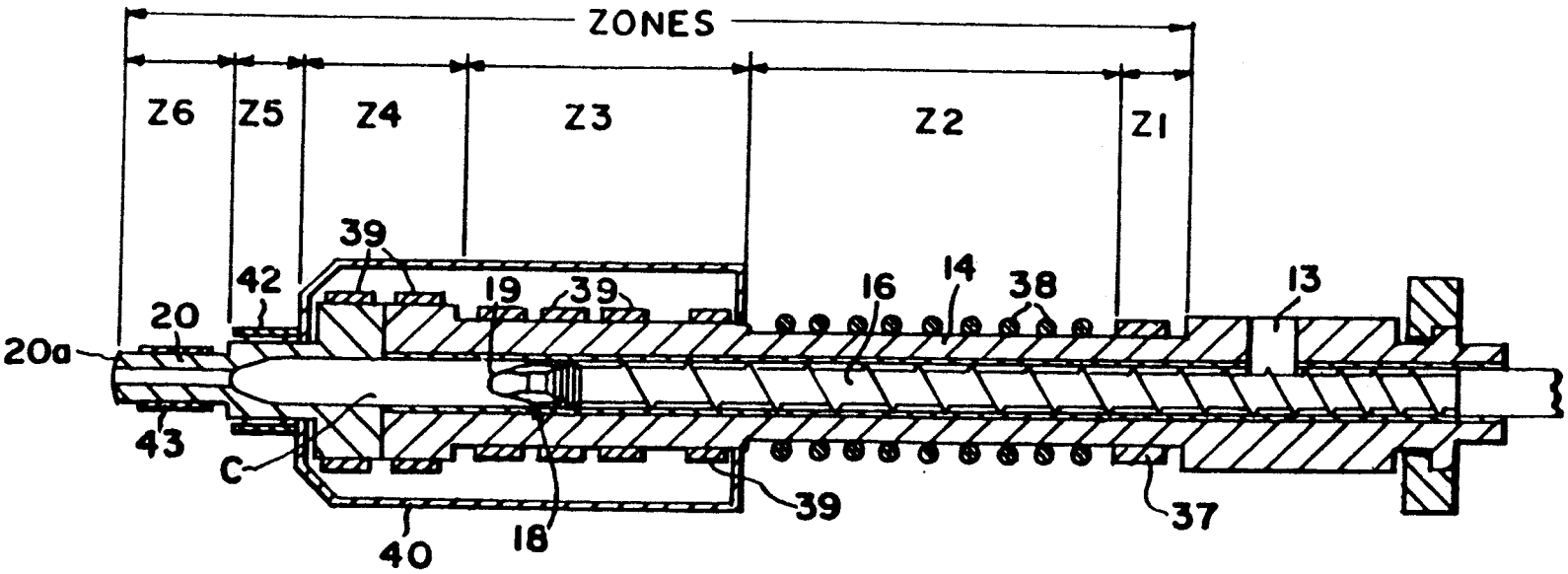
FIG. 3 is a schematic illustration of an extruder barrel and screw, including the application of heating means to establish heating zones.

FIG. 3 illustrates heating apparatus for the extruder which encircles the outer surface of barrel 14 and is preferably divided into heating zones Z1–Z6. In general, the magnesium alloy pellets are heated by conduction through the extruder barrel while the barrel is heated partially by induction and partially by ceramic band resistance heaters. Induction heat responds much faster and can supply a higher watt density than resistance heaters. Resistance heaters, however, are simpler and less costly and can be used once the alloy is approaching maximum temperature and where there is no rapidly changing heat load.

FIG. 3 illustrates the use of a band resistance heater 37 in heating zone Z1 just shortly downstream of the feed throat 13. By way of example, this heater may be capable of supplying 1100 w. Heating zone Z2 utilizes an induction heater coil 38 which may be part of a Lepel S 50/10 heater. Heating zone Z2 extends for a substantial length along barrel 14 and thus induction heater coil 38 is relied upon to heat the metal alloy up to its slush temperature at a relatively fast rate. The power required for induction heating in zone Z2 may be about 25 kw.

In a direction toward nozzle 20, heating zone Z3 utilizes a series of band resistance heaters 39 which may supply 4.7 kw by way of example. Heating zone Z4 utilizes band resistance heaters 39 which may supply up to 3.2 kw. Heating zones Z3 and Z4 are enclosed in a shroud 40 provided with appropriate, controlled air cooling means. These parts may be formed from stainless steel and supplied with an interior layer of 0.5 inch insulation if desired. The temperature of the slush reaches its maximum, or at least very close thereto, in the material accumulation chamber C between the nozzle and the screw tip 19. The accumulation chamber is partly within heating zone Z3 and partly within heating zone Z4.

Zone Z5 utilizes a band resistance heater 42 capable of supplying up to 0.75 kw to maintain a first, relatively high temperature in the upstream portion of the nozzle 20. Heating zone Z6 utilizes a band or coiled, resistance heater 43 capable of supplying up to 0.6 kw and maintains a second, relatively lower temperature in the remainder of nozzle 20 and particularly in the nozzle tip 20*a*.

FIG. 3 illustrates that the feed material is delivered into the barrel 14 adjacent its rear or upstream end. At this end of the barrel only limited heating occurs, but granules of material are introduced by the screw 16 and moved forwardly, or downstream into heating zone ZI and subjected to preliminary heating by the heater 37. The material then is advanced further downstream and subjected to the more pronounced and drastic heating of induction coil 38 at heating zone Z2.

Throughout heating zone Z2 the material is maintained in a semi-solid state while being continuously conveyed downstream of the barrel 14 and successively through the heating zones Z3–Z5. In the zone Z3 the material is thixotropic having degenerate, dendritic, spherical grains and is moved by screw 16 past non-return valve assembly 18 into the shot or material accumulation zone C wherein its temperature is maintained by heaters 39 in heating zone Z4, and preferably slightly increased to prevent dendritic crystalline growth due to the discontinuance of the shearing action. As material is delivered into the accumulation zone C, the volume of such zone continuously is increased by retraction of the screw 16 and at a rate corresponding substantially to the rate of filling of the accumulation zone, thereby avoiding an increase in pressure in the accumulation zone.

At this point in the overall operation it is important to time the peaking of the temperature profile with the introduction of metallic slush into accumulation zone C just prior to making the injection shot. A sufficiently high temperature is maintained in heating zone 4 to retain slush morphology and to prevent alloy solidification which would require much higher than liquidus temperatures to melt and clear. The temperature in heating zone Z4 should be sufficient to prevent the presence of more than about 60% solids in the slush but the temperature in heating zone Z3 should not be sufficiently high to prevent the screw from efficient pumping of the slush. For example, pumping of slush by screw action is highly inefficient at 5% or less solids. Different alloys may require substantially different temperature profiles depending upon alloy content. The determining factor in selecting temperatures is the percentage of solids desired during the final injection molding shot. Mold gating design also may have an effect on selection of temperatures.

Figure 4:
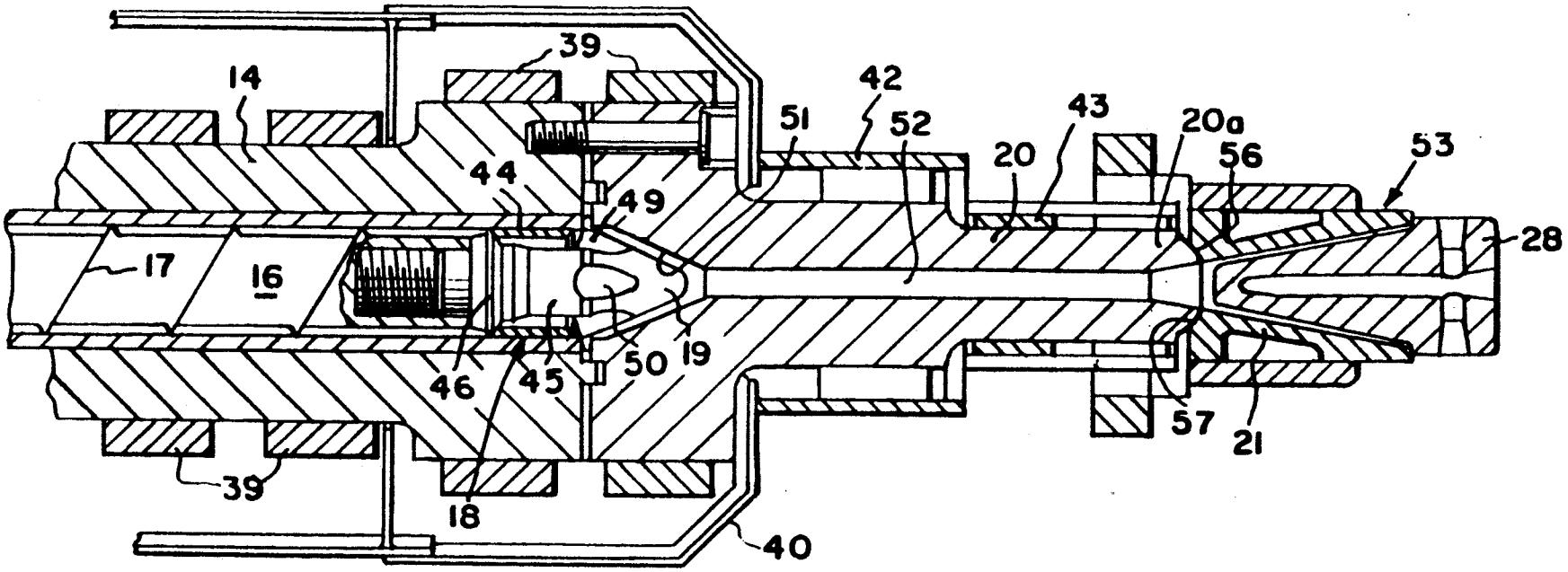
FIG. 4 is an enlarged, fragmentary sectional view of the nozzle end of the injection molding apparatus.
Figure 5:
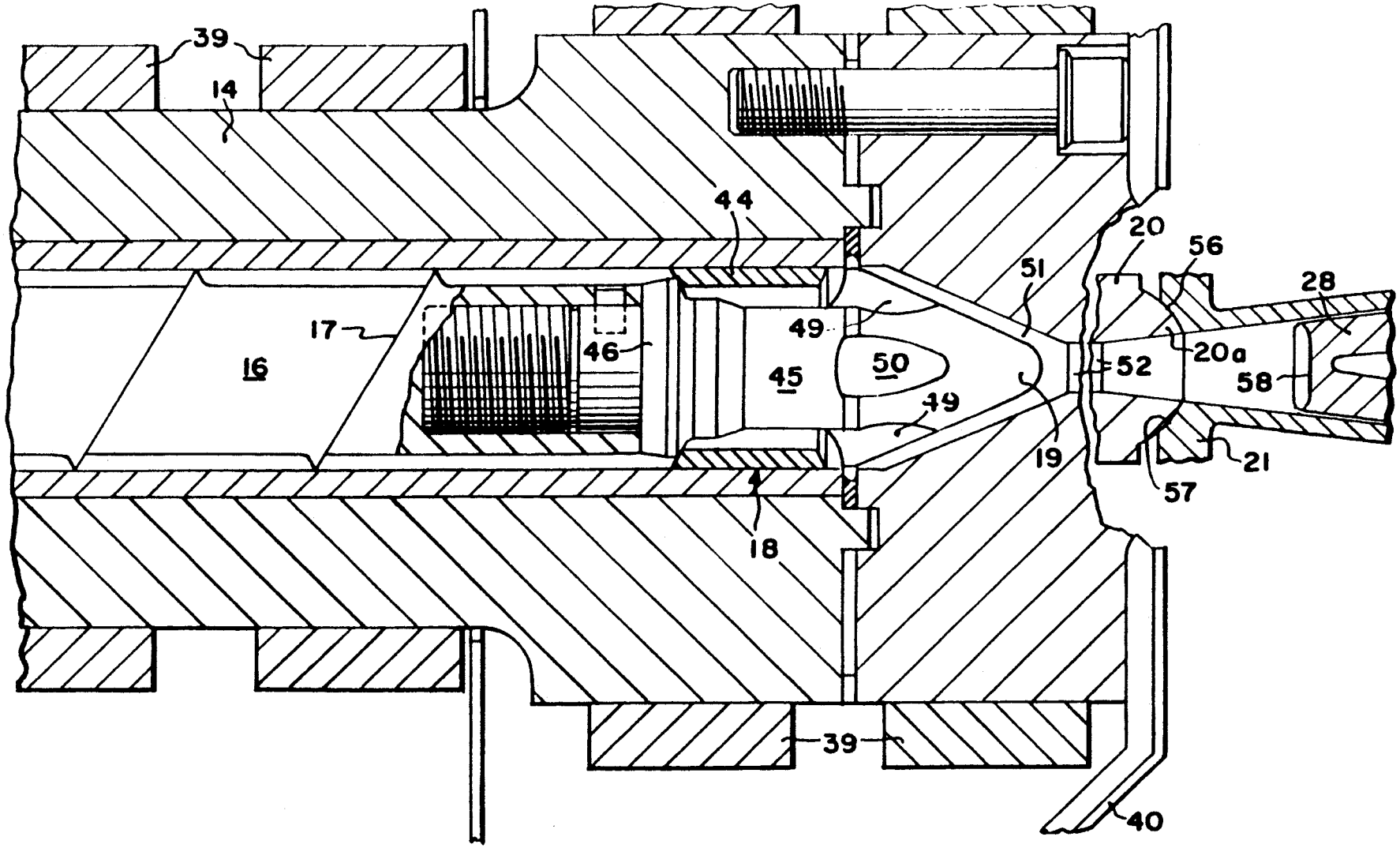
FIG. 5 is an enlarged view of a modified sprue post and nozzle in partial cross section.

The non-return valve assembly 18 is best illustrated in FIGS. 4 and 5. This type of valve is known and comprises a sliding seal ring 44 the outer diameter of which establishes a snug running fit with the interior of barrel 14. Preferably, the clearance between the outer diameter of ring 44 and the inner diameter of barrel 14 is between about 0.5 and 2 mils. Its outer wear surface may be hard surfaced with a suitable material such as Tribaloy T-800 (Stoody-Deloro-Stellite Corporation). Additional cooperative parts constituting the non-return valve assembly 18 include a substantially cylindrical body portion 45 of screw tip 19 terminating rearwardly at a circumferentially continuous, stationary seal ring 46 against which the rear edge of the sliding seal ring 44 may seat to close the non-return valve assembly and prevent reverse flow of slush into the screw area. A substantial clearance exists between the inner diameter of the sliding seal ring 44 and cylindrical body portion 45 of the screw tip. This clearance permits relative axial movement between the sliding seal ring and the cylindrical portion of the screw tip and provides a slush flow area. Sliding seal ring 44 is confined on screw tip 19 by a plurality of ear-like projections 49 having spaces therebetween which define axial slush flow passages 50 in the screw tip 19. The projections 49 extend outwardly into overlapping relation with the adjacent end face of sliding seal ring 44 so as to hold such ring captive on screw tip 19. Thus, continuous rotation of screw 16 delivers slush under pressure around the outer surface of stationary seal ring 46 of screw tip 19 and acts against the adjacent end face of sliding seal ring 44 to move the latter forwardly clear of stationary seal ring 46 to permit slush to flow between the inner diameter of sliding ring 44 and the outer surface of body portion 45 through passages 50 and into the accumulation zone C in advance of screw tip 19. Forward movement of the screw 16 during an injection stroke results in rapid buildup of pressure in the accumulation zone C forcing sliding seal ring 44 rearwardly so as to seat against stationary seal ring 46, thereby preventing slush from flowing rearwardly back into the barrel area during the injection molding shot.

The injection molding machine 10 is intended to operate at much higher injection speeds than occur in thermoplastic injection molding. For example, machine 10 may inject semi-solid alloy at a speed which is on the order of 100 times faster that that of conventional thermoplastic injection molding machines.

The machine 10 combines a reciprocating screw extruder similar to that used in a plastics injection molding system with the high temperatures and shot speeds of a die casting machine. For example, during filling of the mold 22 the screw may move forward at speeds approaching 150 inches per second. Injection apparatus 28 pressure may reach 1850 psi. A typical injection molding machine adapted to handle semi-solid alloys may generate a maximum static force of 35,300 pounds during the injection stroke and 22,600 pounds during the retraction stroke.

FIGS. 4 and 5 illustrate screw 16 in its forwardly projected condition with screw tip 19 received in the forwardly converging inlet 51 to passageway 52 of the nozzle 20. FIG. 4 illustrates the establishing of a seal between the end of extruder nozzle tip 20 and a sprue bushing and runner assembly 53. Such an assembly is of known type including the runner spreader 28 in communication with the mold 22. The outer end of nozzle tip 20*a* surrounding passageway 52 is provided with a convex radius surface 56 which seats on a concave radius surface 57 formed on sprue bushing 21. Convex surface 56 preferably is slightly smaller than convex surface 57 so that a high pressure, line type seal is obtained when the two parts are engaged under suitable force. This arrangement is similar to that utilized in thermoplastic injection molding techniques except that, in thermoplastic injection molding techniques, the nozzle tip is retracted from the sprue bushing to break the resulting sprue.

In practicing the invention it is preferable to maintain nozzle tip 20*a* sealed to sprue bushing 21 for the entire molding operation of numerous cycles, thereby enabling slush residue to solidify or freeze adjacent the outlet end of passageway 52 of nozzle 20 between each successive shot and form a plug of solified metal. The solidified plug acts as a shut-off valve to prevent drool while slush is collecting in the accumulating zone C for a subsequent shot. Upon a further injection stroke, the plug is forced into the mold and is re-melted and/or broken up and dispersed in the part being molded. This procedure eliminates the necessity of utilizing a mechanical valve to prevent drool and also prevents the possibility of oxides or other impurities building up in such a valve and ultimately interfering with effective and safe operation thereof.

Because a pressure buildup of any significance is absent during filling of the accumulation zone C, the plug in injector nozzle tip 20a stays in place between successive shots and effectively functions as a seal. The slight reduction of temperature in zone Z6 (FIG. 3) at the tip of the nozlzle and contact between nozzle tip 20a with mold sprue bushing 21 encourages solidification of the alloy in the nozzle passageway 52. Thus, the plug is formed in a very limited and confined area of the injection molding machine and its formation is delayed until completion of the injection stroke. As a cooler, solidified nature, are limited to the nozzle tip 20a and do not adversely affect the molding operation.

FIG. 5 illustrates a modification of sprue runner spreader 28. The tip of this spreader is concave to form a shallow pocket or recess 58 in which the plug ejected from the nozzle tip 20a may be captured. This construction assists in uniform capture of the leading end of the plug at the very beginning of each injection shot. The ejected semi-solid material from upstream of plug flows over and around the captured plug into the mold 22. The plug thus becomes a part of the scrap that is trimmed from each part after its molding.

Retraction of screw 16 following completion of the injection stroke is effected quite differently from that in thermoplastic injection molding procedures. In a plastics molding machine pressure of the material accumulated in front of the screw extruder is relied upon for retraction of the screw. As described hereinabove, it has been found that in injection molding of magnesium or the like it is best to minimize pressure in the accumulation zone C following completion of a shot thus requiring retraction of the extruder screw 16 by positive reverse operation of the high speed injection apparatus A through appropriate hydraulic control circuits. The retraction rate may vary depending upon the desired duty cycle or elapsed time between successive shots. Retraction rate may be set such that the machine may inject shortly after the extruder screw 16 has reached the fully retracted position. That is, if a 30 second cycle is desired, the retraction rate may be set so that the screw requires approximately 25 seconds to fully retract. Slow retraction allows maximum time for proper heating of the material being advanced by the screw 16 from the feed zone downstream of the barrel 14 and ultimately into the accumulation zone C for the next shot. Complete cycle times depend on shot size and may vary from 10 to 200 seconds.

Figure 6:
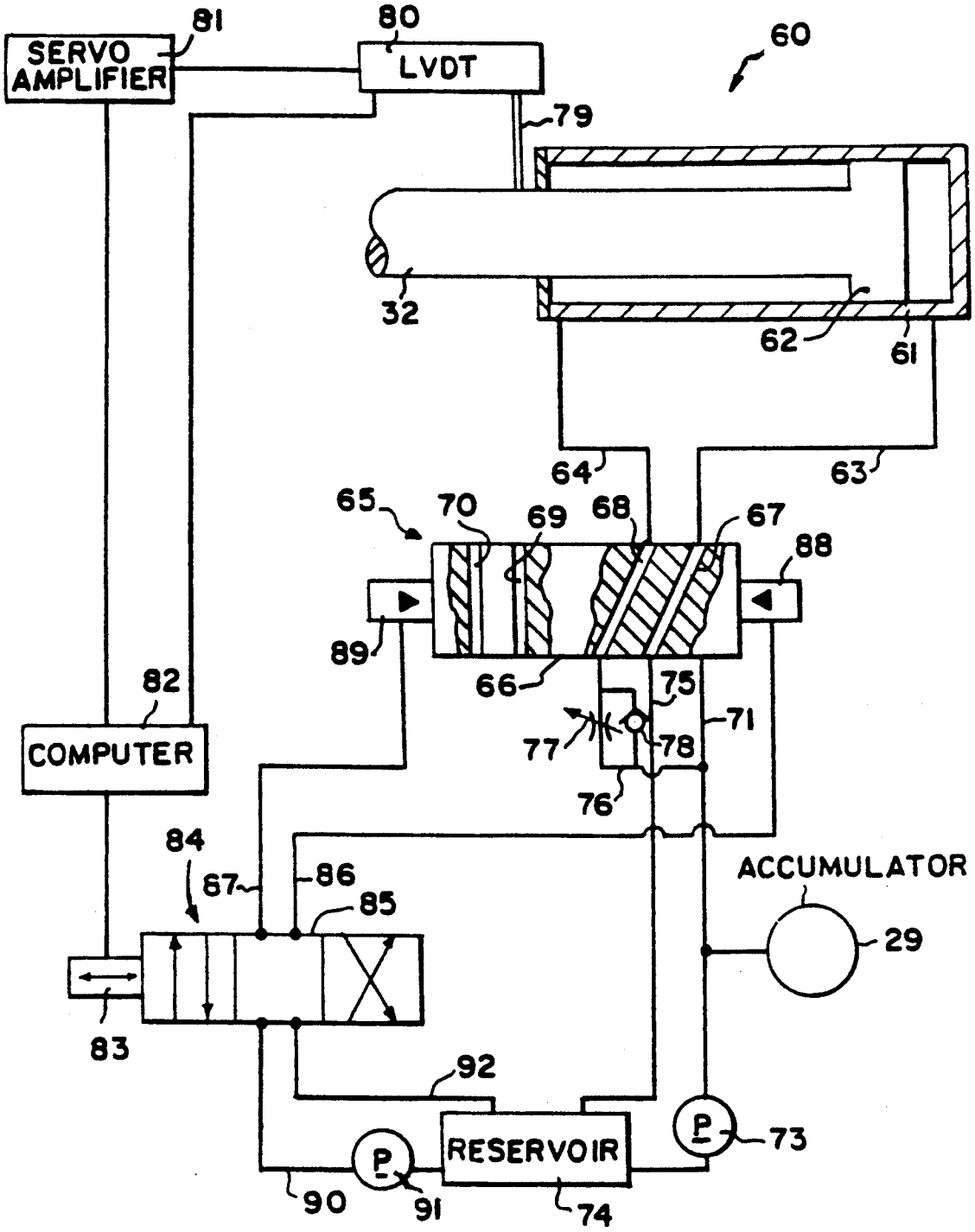
FIG. 6 is a simplified, schematic diagram of a fluid pressure circuit used in controlling the extruder screw.

FIG. 6 discloses, in schematic form, apparatus 60 for controlling the operation of the shot ram 32. With one exception the control apparatus 60 is composed of conventional components.

The shot ram 32 extends into an extension 61 of the cylinder 30 and within which a piston 62 is reciprocable. The piston is connected to the shot ram 32 which is joined to the extruder screw 16 in the manner described earlier. From one end of the cylinder extension 61 extends a hydraulic line 63 and from the opposite end of the extension extends a similar line 64. The lines 63 and 64 communicate with a directional control valve 65 such as an Olmstead HB5Y-16-2-G10 valve. The valve 65 has a reciprocable spool 66 with two pairs of fluid passages 67, 68 and 69, 70 extending therethrough. The valve 65 communicates with a fluid line 71 which is in communication with the pressure fluid accumulator 29, a fluid pump 73, and a fluid reservoir 74. The valve 65 also communicates with a fluid line 75 which extends to the reservoir 74.

The control valve 65 is modified by the inclusion of a branch 76 which establishes communication between the line 71 and the valve 65 via an adjustable flow valve 77 having a by-pass check valve 78. These parts are not conventional in the Olmstead valve referred to above. The purpose of the valve 78 and associated parts will be described shortly.

Fixed to the piston 62 of the shot ram 32 is an actuator 79 forming part of a conventional linear velocity and displacement transducer (LVDT) 80. The transducer 80 is coupled to a conventional servo amplifier 81 and to a computer 82 such as an Allen-Bradley PL2/30 microprocessor. The computer receives an analog signal from the servo amplifier 81 to indicate the speed of movement of the piston 62. The servo amplifier 81 also is coupled to a servo pilot valve 84 such as a Moog 760-104A servo valve. The valve 84 has a reciprocable spool 85 coupled by fluid lines 86 and 87 to spool adjusters 88 and 89, respectively, of the control valve 65. The valve 84 also is coupled by a fluid line 90 to the reservoir 74 via a pump 91 and by a fluid return line 92 to the reservoir.

The control apparatus 60 as shown in FIG. 6 has the piston 62 of the shot ram 32 fully retracted in the cylinder 61 preparatory to making an injection stroke or shot.

In the operation of the control apparatus 60, the servo amplifier 81 receives a signal from the computer 82 to establish the forward shot speed of the piston 62 and will adjust itself according to the signal from the LVDT 80 until the actual speed of the piston 62 agrees with the speed present in the computer 82. The computer 82 may be programmed to change its signal to the servo amplifier 81 according to the position of the ram 32, as measured by LVDT 80. At a preset ram position during the injection stroke the computer 82 changes the signal to servo amplifier 81 to adjust the spool 85 of the pilot valve 84 to effect controlled deceleration of the ram 32. This sometimes is referred to as "deramp."

The control apparatus is activated by the closing of a switch (not shown) in circuit with the computer 82 whereupon the spool 85 of the pilot valve 84 is adjusted by the actuator 83 to establish communication between the pump 91 and the actuator 89 to shift the spool 66 of the control valve 65 to the right, thereby establishing direct communication, via the passage 69, between the right-hand end of the cylinder extension 61, the accumulator 29, and the pump 73. The opposite end of the cylinder extension will be in direct communication with the reservoir 74 via the passage 70 and the line 75. The piston 62 (and consequently the screw 16) thus will move forward rapidly to inject material from the accumulator zone C into the mold 22.

As the piston 62 moves forwardly, the LVDT actuator 79 also will move forwardly. When the actuator reaches the preset deceleration point, the pilot valve 84 responds to signals from the computer 82 and LVDT 80 to adjust the control valve 65 and shift the spool 66 in a direction which will move the passages 67 and 68 partially out of register with the lines 63 and 64, thereby decreasing the quantity of fluid which is admitted to the cylinder extension 61 and decelerating the movement of the piston 62. When the piston reaches the end of its predetermined stroke, the transducer 80 again will operate the pilot valve 84 and shift the spool 66 of the control valve 65 a distance sufficient to terminate the flow of fluid through the passage 69, thereby halting forward movement of the piston 62. The injection stroke then is complete.

Following completion of the injection stroke the signals from the LVDT 80 and the computer 82 will cause the spool 85 of the pilot valve 84 to move to a position in which fluid from the pump 91 effects movement of the spool 66 of the control valve 65 to a position in which the passages 67 and 68 communicate with the fluid lines 75 and 76, respectively. This will enable fluid from the pump 73 to drive the piston 62 rearwardly and retract the feed screw 16 as fresh material is fed into the accumulation zone C in preparation for the making of another shot.

The rate at which the piston 62 and the feed screw 16 are retracted is such as to avoid the build up of pressure in the accumulating zone C sufficient to eject the nozzle sealing plug. The rate of retraction is monitored by the LVDT 80 and compared to the preset rate programmed into the computer 82 so as to effect adjustment of the control valve spool 66 to offset its passages 67 and 68 relative to the fluid lines 75 and 76 and limit or restrict the flow of fluid through the passage 68.

In order to conserve time in establishing the appropriate rate of retraction of the feed screw the adjustable valve 77 can be manipulated manually to provide a positive control over the maximum rate at which fluid may flow through the passage 68. The valve 77 is not essential; it simply reduces the set up time when starting the molding operation. If the valve 77 is used, then the bypass check valve 78 provides for circulation of excess fluid when the spool 66 is adjusted to restrict the flow of fluid through the passage 68.

The length of time taken to retract the feed screw 16 depends upon a number of factors, the principal one of which is the time required to cool and remove a molded part from the mold 22. The molded part cooling time, and consequently the screw retraction time, is sufficiently long to enable the pump 73 to recharge the accumulator 72 as the feed screw is retracted.

Numerous parts have been injection molded and tested for the purpose of evaluating the method and apparatus of the invention. The parts produced included round tensile bars, trapezoidal impact bars, and flat plate corrosion panels to permit determination of mechanical properties including yield strength, ultimate strength, elongation, modulus of elasticity, corrosion, and porosity where appropriate. Certain of these parts compared favorably with the same kinds of parts made in accordance with known commercial high pressure die casting procedures.

A number of different magnesium alloys were used, with nominal compositions as follows:

| ALLOY | CONSTITUENTS |
|---|---|
| AZ91 | 90% Magnesium |
| | 9% Aluminum |
| | 1% Zinc |
| ZK60 | 93.5% Magnesium |
| | 6% Zinc |
| | .5% Zirconium |
| AZ80 | >91% Magnesium |
| | 8% Aluminum |
| | Zinc (trace) |

Various modified compositions of alloy AZ91 also were injection molded as will be indicated. Various molds were used to make the types of parts referred to above, such molds being interchangeable with the injection molding machine of the invention and a standard high pressure die casting machine of known design. Where appropriate, oil heat was used to heat the molds in both operations. Shot size was selected within the range of 0.5 to 1.6 pounds of magnesium depending upon the article being cast. A gate velocity of 800 inches per second was utilized.

Temperature profiles of the various alloys consistent with the temperature zones of FIG. 3 are set forth below along with details concerning die temperature, extruder setup, and shot setup.

| TEMPERATURE PROFILES (°C.) | | | |
|---|---|---|---|
| | AZ91 ALLOYS (INCLUDING COMPOSITES) | ZK60 | AZ80 |
| ZONE 1 | 575 | 630 | 575 |
| ZONE 2 | 580 | 632 | 580 |
| ZONE 3 | 582 | 634 | 582 |
| ZONE 4 | 584 | 635 | 584 |
| ZONE 5 | 585 | 635 | 585 |
| ZONE 6 | 565 | 620 | 565 |
| DIE TEMPERATURE | 232 | 232 | 232 |
| EXTRUDER SETUP | | | |
| FEED RATE | 30 lb/hr | | |
| FEED TIME | 60 sec (die upper position) | | |
| | 70 sec (die lower position) | | |
| RETRACT TIME | 75 seconds (over 2.4 inches of travel) | | |
| SCREW SPEED | 125 rpm | | |
| SCREW RETRACTION FOR DIE OPEN | 0.375 inch | | |
| SHOT SETUP | | | |
| FAST SHOT 1 SPEED | 120 in/sec | | |
| FAST SHOT 2 SPEED | 135 in/sec | | |
| LOW IMPACT SPEED | 10 in/sec | | |
| START FAST SHOT 2 POSITION | 0.2" | | |
| LOW IMPACT POSITION | 1.45" | | |
| | 1.55" | | |
| SHOT CYCLE (DWELL) TIME | 2.0 sec. | | |

As there is no appreciable pressure buildup in the accumulation chamber and the plug is capable of preventing drool or dangerous discharge of molten material from the extruder, there is no need for the provision of a special sprue breaking mechanism in the injection molding machine of the invention. It is necessary merely to open the mold 22 to break the solidified plug and in this respect such opening occurred with the screw 16 retracted 0.375 inch.

Fast shot 1 speed, fast shot 2 speed, and low impact speed deal with the actual injection stroke. The first speed is relied upon to initiate the injection stroke, the second speed determines the maximum shot speed for filling the mold cavity, and the low impact speed is to slow the screw 16 such that it stops moving forward just as the mold 22 is completely filled. This prevents impact due to momentum of the extruder screw 16 and high speed injection apparatus A.

FIG. 2 illustrates what occurs during a typical injection shot. Particular speeds and transition positions may have an effect on molded part quality. If the injection speed is too slow, premature solidification of the alloy occurs in the gates and runners of the mold 22 and a short shot results. If the injection speed is too high, atomization of the charge can occur resulting in greatly increased levels of porosity in the part. The ideal speed or combination of speeds is that under which the plug freezes or solidifies in the nozzle tip 20*a* just as the mold is completely filled. Generally, fast shot 2 speed was initiated approximately 0.01 inch into the shot, and the low impact speed was initiated approximately 0.02 inch later.

was determined using the Archimedes immersion principle and showed that for the injection molded parts there was about 50 percent reduction in porosity from greater than 3% to approximately 1.5% as compared to the die cast parts. The significantly reduced porosity is believed to be due to a combination of factors, but primarily to the increased viscosity of the semi-solid slush as opposed to the much lower viscosity of molten metal.

Since the metal alloy was partially solidified before being injected into the mold, the resulting higher viscosity produced less turbulence in the shot zone and in the runners of the mold. It also permitted the mold cavity to be filled with a solid front fill instead of the spraying and swirling patterns associated with high pressure, liquid metal die casting. The injection of partially solid material into a mold also results in less shrinkage due to solidification of liquid metal.

It is often desirable to add a discontinuous phase in a metal part to form a composite which enhances certain properties. For example, alumina particles can be added to a magnesium alloy that is to be die cast to enhance the wear resistance of the die cast part. Alternatively, silicon or boron carbide fibers or whiskers can be added to such magnesium alloy for reinforcement, thus enhancing the mechanical properties of the part. The present invention permits fabrication of such composite parts.

Gear case covers of the type referred to above were successfully injection molded using alloy containing approximately 0.5% by weight of alumina particles.

PROPERTY COMPARISONS
DIE CAST (HPDC) VS. INJECTION MOLDED (MIM)

| TYPE | ALLOY | TYS, KSI | UTS, KSI | ELONG. % | MODULUS $10^6$ PSI | CORROSION MILS/YR. | POROSITY % |
|---|---|---|---|---|---|---|---|
| HPDC | AZ91XD | 23.1 | 30.5 | 3.3 | | <10 | 3.2 |
| MIM | AZ91XD[A,B] | 23.4 | 30.6 | 3.9 | 6.2 | 6.0 | 1.7 |
| MIM | AZ80 | 21 | 30 | 3 | | | |
| MIM | AZ91B[C] | | | GEAR CASE COVER | | | 1.4 |

A = 10-30% SOLIDS
B = PRIMARY SOLIDS <50 MICRONS
C = 40-50% SOLIDS

Of the various compositions of the alloy AZ91 listed above, AZ91XD includes a trace amount of berylium with special care being taken to reduce impurities to aid in corrosion resistance. AZ91B includes a trace amount of berylium for the purpose of retarding burning.

Although the percentage of solids established in the slush varied considerably in certain tests, the resulting parts were completely acceptable. Tensile yield strength and ultimate tensile strength, both measured in kilograms per square inch, as well as percent elongation, are comparable with both die cast and injection molded parts. The corrosion rates listed were determined from a standard 10 day salt/fog test where the parts were prepared by sanding or tumbling to a common surface condition and weighed before and after testing. The results are reported as an equivalent number of mils corroded per year. Hence, the corrosion rates in injection molded parts averaged less than 10 mils per year and were equivalent to similar high purity die cast parts. The mechanical properties were determined from test bars taken from the parts with a round cross section and 2 inches gage length.

In porosity comparison tests, a commercial gear case cover produced by high pressure die casting was compared with the same cover produced by the method of the invention. The injection molded gear case cover exhibited less porosity. The density of the parts tested Distribution of the alumina in the fabricated parts was found to be very uniform. Similarily, 2% by weight alumina was added to alloy AZ91XD for the purpose of improving wear resistance. Injection molded parts tested showed the alumina to be uniformly distributed with no adverse effects on surface quality.

In the injection molding of the various parts indicated above, basic machine components manufactured by Ex-Cell-O Corporation, Holland, Mich., were used. Also used were the aforementioned Allen Bradley microprocessor and a data acquisition system which includes a Nicolet digital oscilloscope to capture shot velocities and pressures.

Extended runs have been made to assess the performance of the injection molding machine and process, such runs including, in at least one instance, a duration of over 16 hours involving in excess of 800 shots. No purge shots were required. The injection molding machine performed well and the process data showed no signs of deterioration of the process. On the contrary, the shots and temperature profiles became more stable during longer periods of operation.

During extended runs the duty cycle may be decreased or increased. For example, a duty cycle of 90 seconds was decreased to 60 seconds, then to 45 seconds, and then finally to 30 seconds for periods of one hour each. No adverse effects on part quality or process performance were observed.

As has been explained, many advantages are derived from the improved injection molding method and apparatus of the present invention. The advantages attendant the die casting of metal parts are retained while melt loss problems, contamination, scrap, and limited positional die filling are eliminated.

As compared with die casting operations, the present invention provides improved yields, significantly lower energy consumption, increased productivity, and improved mold life.

The invention enables many of the inherent advantages of injection molding of thermoplastic materials to be obtained in the casting of thixotropic metallic parts. However, significant modifications to conventional thermoplastic injection molding procedures have been found desirable. For example, starve feeding as distinguished from thermoplastic flood feeding is advantageous. Further, substantially higher temperatures are utilized with carefully selected temperature profiles.

Zone temperature control and discontinuance of shearing action can result in the formation of a nozzle tip plug which not only eliminates the added complexity and problems arising from use of a conventional, spring loaded or other type of mechanical shut-off valve, but also substantially improves safety conditions relating to injection molding operations. Normal wear taking place in a shut-off valve can result in drool or explosive discharge of hot material which not only creates a potential danger to the operators, but also adds to the further wear of the valve mechanism.

An important solution to the problem of injection molding of molten metal resides in the careful matching of the throughput rate of semi-solid material and the retraction rate of the extruder screw 16 so that no appreciable pressure is generated in the material accumulation zone C prior to the injection molding shot. Using an appropriate temperature profile for a given magnesium alloy which steadily increases the temperature of such alloy, but slightly reduces the temperature in the extruder nozzle tip area, combined with proper selection of speeds of the screw extruder throughout the cycle of operation, greatly assist in attaining this solution. During the shot portion of the cycle the velocity of the extruder screw 16 should initially rise to the desired maximum and remain at approximately such maximum for most of the shot, but just before completion of the full stroke the extruder screw should slow to low impact velocity and stop without rebound as the mold 22 becomes filled.

A wide range of articles or parts, including thin walled parts, of reduced porosity can be manufactured in accordance with the invention from semi-solid materials ultimately exhibiting a metallic matrix.

What is claimed is:

1. A method of injection molding a metallic material having dendritic properties comprising:

(a) introducing said material into an extruder barrel terminating at one end in a discharge nozzle;

(b) moving said material through said barrel toward an accumulation zone adjacent said nozzle;

(c) heating said material to a temperature between its solidus and liquidus temperatures to convert said material to a semi-solid, thixotropic state;

(d) shearing said material during its movement toward said accumulation zone to inhibit dendritic growth;

(e) expanding said accumulation zone independently of the movement of said material into said zone and at a rate at least as great as that at which said material is moved into said accumulation zone;

(f) discontinuing shearing of said material in said accumulation zone;

(g) maintaining the temperature of material in said accumulation zone at a level to inhibit dendritic growth; and (h) periodically applying to material accumulated in said accumulation zone sufficient force to discharge material accumulated in said zone through said nozzle into a mold.

2. The method of claim 1 including forming a substantially solid plug of said material in said nozzle upon completion of the discharge of material into said mold.

3. The method of claim 2 including introducing said material into said barrel at a rate less than 100 percent of its capacity.

4. The method of claim 2 wherein said material is an alloy containing magnesium.

5. The method of claim 2 wherein said plug constitutes the sole, unassisted closure for said nozzle.

6. The method of claim 1 including introducing said material into the extruder at a rate less than 100 percent of its capacity.

7. The method of claim 6 wherein said material is an alloy containing magnesium.

8. The method of claim 1 wherein said material is an alloy containing magnesium.

9. The method of claim 8 wherein said alloy has a discontinuous phase material forming a part thereof.

10. The method of claim 9 wherein the alloy is introduced into said barrel at a rate less than 100 percent of its capacity.

11. The method of claim 1 wherein the rate of movement of said material along said barrel is substantially independent of the shearing rate of said material.

12. The method of claim 1 including raising the temperature of material in said accumulation zone to a higher level than that of said material elsewhere.

13. The method of claim 12 wherein the temperature of material in said accumulation zone is raised to and maintained at a level at which said material remains semi-solid but dendritic growth is inhibited.

14. The method of claim 12 wherein the temperature of material in said accumulating zone is maintained at a level below its liquidus temperature.

15. The method of claim 1 including maintaining a rate of shear of said material of between about 5 and 500 reciprocal seconds.

16. A method of injection molding a metallic material having dendritic properties comprising:

(a) feeding said material into a screw extruder barrel having a discharge nozzle at one end;

(b) advancing said material through said barrel in a direction toward said nozzle;

(c) heating said material as it advances through said barrel to establish a temperature profile which maintains the material in a semi-solid state above its solidus temperature and below its liquidus temperature;

(d) subjecting the material to shearing as said material advances through the barrel;

(e) accumulating a quantity of material in an accumulation zone at the said one end of said barrel;

(f) discontinuing the shearing of said material as said quantity thereof enters said zone;

(g) raising the temperature of said quantity of material in said zone to a level to inhibit dendritic growth while maintaining said material in its semi-solid state;

(h) applying force to the material in said zone to inject such material into a mold; and (i) terminating the application of said force when a predetermined quantity of such material has been injected into said mold.

17. The method of claim 16 wherein said material is a magnesium alloy.

18. The method of claim 17 wherein said alloy has a discontinuous phase material forming a part thereof.

19. The method of claim 16 wherein the material is fed into the barrel of the extruder at a rate less than 100 percent of its capacity.

20. The method of claim 16 including forming a substantially solid plug in said nozzle from said semi-solid material following the termination of the application of said force.

21. The method of claim 16 wherein said extruder has a rotatable screw in said barrel, and rotating said screw at a speed of between about 125 and 175 rpm.

22. The method of claim 16 including maintaining a cycle time of the extruder of between about 15 and 200 seconds.

23. The method of claim 16 including maintaining a rate of shear of said semi-solid material of between about 5 and 500 reciprocal seconds.

24. The method of claim 16 wherein said temperature profile has its highest temperature in said accumulation zone.

25. Apparatus for injection molding a metallic material having dendritic properties, said apparatus comprising:

(a) an extruder barrel having a discharge nozzle at one end, a material accumulation zone adjacent said nozzle, and an inlet remote from said nozzle;

(b) feeding means for introducing said material into said barrel via said inlet;

(c) means for heating material in said barrel to a temperature which is sufficiently high to inhibit dendritic growth;

(d) means for moving material through said barrel from said inlet into said accumulation zone;

(e) means for expanding said accumulation zone independently of the movement of material into said accumulation zone and at a rate at least as great as that at which said material is moved into said accumulation zone, thereby avoiding the imposition of appreciable force on material in said accumulation zone;

(f) means for shearing said material as it moves through said barrel between said inlet and said accumulation zone; and (g) means for discharging material from said accumulation zone through said nozzle into a mold.

26. The apparatus of claim 25 wherein said barrel has a plurality of longitudinally spaced heating zones, each of which is heated by said heating means to establish for said material a temperature profile which increases in a direction toward said nozzle.

27. The apparatus of claim 25 wherein said feeding means includes means for introducing material into said barrel at a rate less than 100 percent of its capacity.

28. The apparatus of claim 25 wherein the means for moving said material through said barrel comprises an extruder screw, and means mounting said screw in said barrel for rotary and axial movements relative to said barrel.

29. The apparatus of claim 25 wherein the means for expanding said accumulation zone comprises means for moving said screw in a direction away from said nozzle.

30. The apparatus of claim 25 including means for lowering the temperature of material in said nozzle following completion of the discharge of material from said accumulation zone to a level at which such material solidifies and forms a plug.

31. The apparatus of claim 30 wherein said plug comprises the sole, unassisted closure for said nozzle.

32. The apparatus of claim 25 wherein said heating means maintains the temperature of material in said accumulation zone at a level higher than elsewhere.

33. The apparatus of claim 25 wherein the material introduced via said feeder into said barrel is in pellet form.

34. The apparatus of claim 25 wherein the material introduced into said barrel is at ambient temperature.

35. The apparatus of claim 25 wherein said heating means maintains the temperature of material in said barrel between the liquidus and the solidus temperatures of said material.

36. Apparatus for injection molding a metallic material comprising:

(a) an extruder barrel having a discharge nozzle at one end, a material accumulation zone adjacent said nozzle, an inlet remote from said nozzle, and a shearing zone between said accumulation zone and said inlet;

(b) means for moving said material through said barrel from said inlet into said accumulation zone;

(c) means for heating material in said barrel to a temperature between its solidus and liquidus temperatures and which is sufficiently high to maintain said material in a semi-solid thixotropic state;

(d) means for shearing material as its moves through said shearing zone;

(e) means for discharging material from said accumulation zone through said nozzle into a mold, (f) said heating means including means for concentrating heat at said accumulation zone so as to maintain the temperature of said semi-solid material in said accumulation zone at a level higher than elsewhere in said barrel.

37. The apparatus of claim 36 wherein said feeding means includes metering means for introducing material into said barrel at a rate less than 100 percent of its capacity.

38. The apparatus of claim 36 wherein the means for moving said material through said barrel comprises an extruder screw, and means mounting said screw in said barrel for rotary and axial movements relative to said barrel.

39. The apparatus of claim 36 including means for lowering the temperature of material in said nozzle following completion of the discharge of material from said accumulation zone to a level at which such material solidifies and forms a plug.

40. The apparatus of claim 39 wherein said plug comprises the sole, unassisted closure for said nozzle.

41. The apparatus of claim 36 wherein the material introduced via said feeder into said barrel is in pellet form.

42. The apparatus of claim 36 wherein the material introduced via said feeder into said barrel is at ambient temperature.

43. The apparatus of claim 36 wherein the material introduced via said feeder into said barrel is maintained in an inert atmosphere.

44. The apparatus of claim 36 wherein said barrel has an inner liner formed of material having a high cobalt content.

45. The apparatus of claim 36 wherein said barrel is formed of material having a high nickel content.

46. The apparatus of claim 36 wherein said screw has a hardening material on its outer surface.

47. The apparatus of claim 36 including a mold having a cavity and a passage in communication with said nozzle and said cavity for conducting material ejected from said nozzle to said cavity.

48. The apparatus of claim 47 including a post accommodated in said passage, said post having a body terminating in a tip confronting said nozzle.

49. The apparatus of claim 48 wherein said tip is convex.

50. The apparatus of claim 48 wherein said tip has a cavity threrein.

51. A method of molding an object from a solid substance having dendritic properties, said method comprising heating said substance to a temperature at which said substance comprises a mixture of liquid and solid components; shearing said mixture to inhibit dendritic growth; delivering said mixture to an accumulation zone; discontinuing the shearing of said mixture in said accumulation zone and increasing the temperature of such mixture in said accumulation zone to a level at which said mixture remains semi-solid and dendritic growth is inhibited in the absence of shearing; and discharging said mixture from said accumulation zone into a mold.

52. The method of claim 51 including increasing the temperature of said mixture in said accumulation zone upon the discontinuation of said shearing.

53. Apparatus for molding an object from a solid metallic substance having dendritic properties, said apparatus comprising means for heating said substance to a temperature at which said substance is semi-solid and at which dendrictic growth is inhibited; means for shearing said semi-solid substance; means for moving said semi-solid substance to a zone in which no shearing occurs; means for raising and maintaining the temperature of the substance in said zone to a level at which said substance remains semi-solid but dendritic growth is inhibited; nozzle means in communication with said zone; and means for discharging from said zone through said nozzle means a quantity of said semi-solid substance sufficient to fill a mold, a residue of said semi-solid substance remaining in said nozzle.

54. The apparatus of claim 53 including means for cooling the residue remaining in said nozzle means to a temperature at which the substance therein solidifies.

55. A method of injection molding an initially solid metallic material comprising:

(a) introducing solid particles of said material via an inlet into an extruder barrel terminating at one end in a discharge nozzle;

(b) advancing said material along said barrel downstream from said inlet toward said nozzle, said barrel having a material accumulation zone upstream of said nozzle into which said semi-solid material is delivered and accumulated between successive discharges thereof through said nozzle;

(c) heating the material in said barrel to a temperature between its solidus and liquidus temperatures to convert said material to a semi-solid state;

(d) periodically discharging a quantity of said semi-solid material from said barrel through said nozzle into a mold;

(e) terminating each discharge of said semi-solid material from said barrel in time to enable a residue of said semi-solid material to remain in said nozzle;

(f) solidifying said residue to form a solid plug in said nozzle which seals said nozzle; and (g) expanding said accumulation zone independently of the delivery of said material thereto and at such rate relative to that at which said material is delivered to said accumulation zone as to avoid imposing on material in said accumulation zone between successive discharges a force sufficient to dislodge said solid plug.

56. The method according to claim 55 wherein said solid plug forms the sole, unassisted closure for said nozzle.

57. Apparatus for injection molding an initially solid, metallic material comprising:

(a) extruder means having an inlet and a discharge nozzle spaced downstream from said inlet;

(b) means for introducing solid particles of said material to said extruder means via said inlet;

(c) means for advancing said material downstream of said extruder means toward said nozzle into an accumulation zone in said extruder means upstream from said nozzle;

(d) means for heating the material in said extruder means to a temperature between its solidus and liquidus temperatures to convert said material to a semi-solid state;

(e) means for periodically discharging semi-solid material from said extruder means through said nozzle in such quantity as to cause a residue of said semi-solid material to remain in said nozzle between successive discharges;

(f) means for solidifying said residue of said material in said nozzle between each successive discharge to form a solid plug; and (g) means for expanding said accumulation zone between successive discharges at such rate relative to the rate of introduction of material to said accumulation zone as to avoid imposing appreciable force on material in said accumulation zone, thereby avoiding dislodging of said solid plug between successive discharges.

58. The apparatus according to claim 57 wherein said solid plug forms the sole, unassisted closure for said nozzle.

* * * * *

UNITED STATES PATENT AND TRADEMARK OFFICE

CERTIFICATE OF CORRECTION

PATENT NO. : 5,040,589

DATED : August 20, 1991

INVENTOR(S) : Norbert 1. Bradley, et al.

It is certified that error appears in the above-identified patent and that said Letters Patent is hereby corrected as shown below:

On the title page under the References Cited Section, U.S. Patents "4,694,881", should correctly read --4,694,881--.

Signed and Sealed this

Nineteenth Day of January, 1993

*Attest:*

DOUGLAS B. COMER

*Attesting Officer*

*Acting Commissioner of Patents and Trademarks*